US009689097B2

(12) United States Patent
Stoll

(10) Patent No.: US 9,689,097 B2
(45) Date of Patent: Jun. 27, 2017

(54) NONWOVEN COMPOSITE FABRIC AND PANEL MADE THEREFROM

(71) Applicant: Wm. T. Burnett IP, LLC, Baltimore, MD (US)

(72) Inventor: John Robert Stoll, Suwanee, GA (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 0 days.

(21) Appl. No.: 13/904,417

(22) Filed: May 29, 2013

(65) Prior Publication Data

US 2013/0330994 A1 Dec. 12, 2013

Related U.S. Application Data

(60) Provisional application No. 61/653,770, filed on May 31, 2012.

(51) Int. Cl.
*D04H 1/46* (2012.01)
*D04H 1/4218* (2012.01)
*D04H 1/541* (2012.01)

(52) U.S. Cl.
CPC ..... *D04H 1/46* (2013.01); *D04H 1/4218* (2013.01); *D04H 1/541* (2013.01); *Y10T 442/609* (2015.04)

(58) Field of Classification Search
USPC ..... 442/361–364, 415, 367; 428/221, 228
See application file for complete search history.

(56) References Cited

U.S. PATENT DOCUMENTS 4,795,668 A * 1/1989 Krueger et al. ..... 428/174
4,889,764 A 12/1989 Chenoweth et al.
5,167,765 A 12/1992 Nielsen et al.
6,159,882 A 12/2000 Kean et al.
6,649,547 B1 11/2003 Arnold et al.
7,138,023 B2 11/2006 Haque et al.
7,598,187 B2 10/2009 Hallam et al.
7,605,097 B2 10/2009 Thompson et al.
7,608,125 B2 10/2009 Jaffee
7,651,964 B2 1/2010 Thompson et al.
2002/0193030 A1* 12/2002 Yao et al. ..... 442/366
2003/0060113 A1 3/2003 Christie et al.
2003/0109190 A1 6/2003 Geel
2003/0176131 A1 9/2003 Tilton
2005/0160711 A1 7/2005 Yang
2008/0057283 A1 3/2008 Blinkhorn et al.
2009/0085378 A1* 4/2009 Borchardt et al. ..... 296/191
2009/0227166 A1 9/2009 Goda
2009/0298374 A1 12/2009 Delmas
2010/0112881 A1 5/2010 Bahukudumbi
2011/0121482 A1* 5/2011 Roekens et al. ..... 264/128
(Continued)

FOREIGN PATENT DOCUMENTS

JP 09041256 2/1997
WO 2005075054 8/2005
WO 2005080659 9/2005

OTHER PUBLICATIONS

International Search Report and Written Opinion dated Nov. 18, 2013 in International Application No. PCT/US2013/043210.
(Continued)

*Primary Examiner* — Lynda Salvatore
(74) *Attorney, Agent, or Firm* — Plumsea Law Group, LLC

(57) ABSTRACT

Tough, durable nonwoven composite fabric panel product and two precursors thereof.

20 Claims, 5 Drawing Sheets

(56) References Cited

U.S. PATENT DOCUMENTS

2012/0115387 A1* 5/2012 Nakagawa ..... 442/350
2012/0251796 A1* 10/2012 Potter et al. ..... 428/195.1

OTHER PUBLICATIONS

Notification Concerning Transmittal of International Preliminary Report on Patentability, mailed Dec. 11, 2014 in International Application No. PCT/US2013/043210.

* cited by examiner 100
102
Blender
104
106
Carder
107
108
Cross-Lapper
109
110
Tacker Needle
111
112
Needle Loom
113
114
Surface Re-Wind
116
Center Driven Re-Wind

NONWOVEN COMPOSITE FABRIC AND PANEL MADE THEREFROM

This application claims priority under 35 U.S.C. §119(e) to U.S. Provisional Patent Application No. 61/653,770, entitled NONWOVEN COMPOSITE FABRIC AND PANEL MADE THEREFROM, and filed May 31, 2012, which application is herein incorporated by reference in its entirety.

BACKGROUND

The present disclosure relates generally to nonwoven composite fabric. In particular, the disclosure relates to a nonwoven composite fabric comprising polyethylene terephthalate and mineral fiber, and to a panel made therefrom.

Nonwoven composite fabric encompasses a variety of thin sheet materials and thin-wall materials. These nonwoven composite fabric products may be a lofted material suitably used as insulation, or may be a pressed material suitable for use as thin sheet materials and thin-wall materials, such as divider panels and protective panels, for example. Nonwoven composite fabric may be flexible or rigid. Rigid panels may be three-dimensional rather than two-dimensional.

Typically, nonwoven composite fabric comprises filaments or fibers bound mechanically, chemically, or thermally. The filaments or fibers are not woven or knitted, but rather are bound together. Thus, the fibers need not be formed into yarn, but rather can be used directly, for example, as roving. Also, shorter fibers often can be used in nonwoven composite fabric than is required for spinning to convert a roving into a yarn.

Manufacture of nonwoven composite fabric requires arrangement of the fibers so that they can be bound together. Fibers can be wet-laid or carded, natural or synthetic, and can be arranged in single or multiple plies. Binding can be mechanical, such as by needling (interlocking the fibers by pressing into the web serrated needles that snag fibers and carry them in the thickness direction). Fibers also can be bound chemically, for example, with an adhesive. Thermal binding typically involves application or distribution of a binder within the fibers, then melting the binder onto the fibers by increasing temperature.

Nonwoven composite fabrics have been made using fibers from various sources that have been bound in the manners known to the skilled practitioner. Nonwoven composite fabrics have properties and characteristics that can be manipulated to an extent by processing the arranged fibers and binders during the binding step. For example, the nonwoven composite fabric can be pressed to compact the fabric before any adhesive sets completely or while any binder is not solidified. Compression typically increases strength of the nonwoven composite fabric with the cost of reduced flexibility.

Nonwoven composite fabric has been adapted for many uses. For example, nonwoven composite fabric has been used to manufacture various products, such as filters; insulation; clothing, such as disposable hospital gowns; absorbent articles of various types, including as a 'dry feel' surface for an absorbent article; acoustical dampener; wipes of various types; upholstery and headliners for vehicles; agricultural fabrics; surgical gowns, caps, and drapes; masks; roofing products; and many other products. Nonwoven composite fabric can be made to be soft, as for gowns and drapes, or can be made stiff or rigid, as for masks and acoustical dampener. Thus, nonwoven composite fabric can be versatile.

However, properties and characteristics of nonwoven composite fabric comprising a given combination of fiber and binder or adhesive cannot be manipulated without limitation. For example, strength of a nonwoven composite fabric is reflected in tensile strength, toughness, flexibility, and resistance to puncture, for example. Strength may be limited, inter alia, by the strength of the fibers, the strength of the binding system, and the degree of processing. These and other limitations on the construction of nonwoven composite fabrics limit the ranges of properties and characteristics of the resultant products of the given combination of fiber and adhesive or binder.

Therefore, there exists a need in the art for improvements in nonwoven composite fabrics to produce products that have properties and characteristics that make them suitable for selected uses requiring high strength and rigidity, for example, and provide nonwoven composite fabrics for uses not contemplated for known products.

SUMMARY

The disclosure is directed generally to a nonwoven composite fabric web, a nonwoven composite fabric partially bonded web, and to a nonwoven composite fabric panel. The web is a precursor to the partially bonded web and to the panel, and the partially bonded web is a precursor to the panel. The disclosure also is directed to a method for making the nonwoven composite fabric. In particular, in one aspect, the disclosure relates to a method for making nonwoven composite fabric. In another aspect, the disclosure is directed to a method for forming a rigid nonwoven composite fabric panel having high strength and excellent acoustical suppression.

The disclosure also relates to a nonwoven composite fabric comprising polyethylene terephthalate and mineral fiber. The nonwoven composite fabric can be in the form of a web, a partially bonded web, and a panel. In another aspect, the disclosure is directed to a nonwoven composite fabric panel that can be manipulated, such as by pressing, to form a nonwoven composite fabric rigid panel having high strength and excellent acoustical suppression. In another aspect, the disclosure also relates to the nonwoven composite fabric rigid panel having high strength, excellent acoustical suppression, and other significant properties and characteristics.

Other systems, methods, features, and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
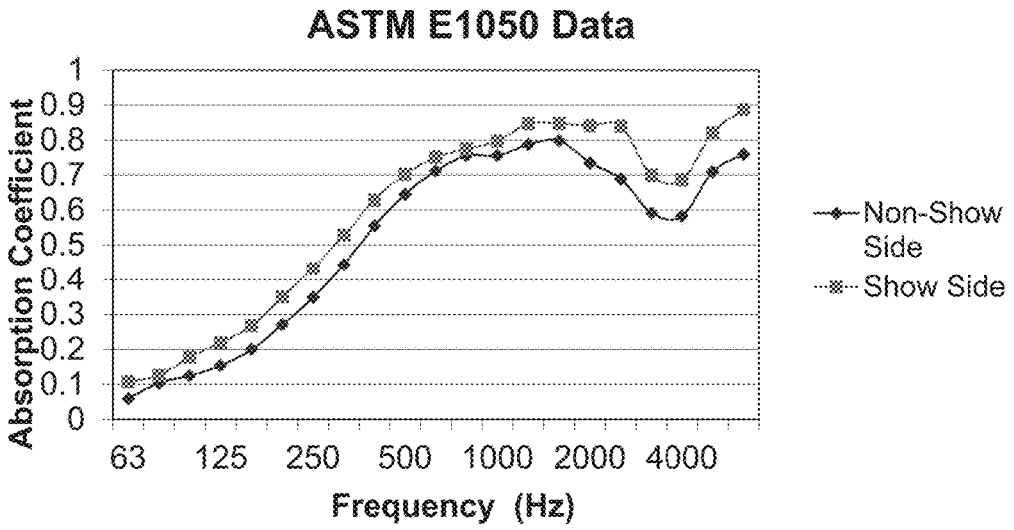
FIG. 1 depicts a portion of a chart that reports the absorption coefficient of a nonwoven composite fabric panel of the disclosure as a function of frequency.

In an embodiment, the disclosure is directed to a nonwoven composite fabric web and a partially bonded web. Embodiments of the disclosure are directed to a rigid nonwoven composite fabric panel having high strength, excellent acoustical suppression, and other significant properties and characteristics.

In another embodiment, the disclosure is directed to a method for making a nonwoven composite fabric. In still another embodiment, the disclosure is directed to a method for forming a rigid nonwoven composite fabric panel having high strength and excellent acoustical suppression.

Embodiments of the disclosure are directed to nonwoven composite fabric. In these embodiments, nonwoven composite fabric is a nonwoven mat or web comprising a matrix of mineral fibers and polymeric fibers. The mineral fibers, which include glass fibers, remain essentially unchanged during processing to form the mat and processing to form a rigid nonwoven composite fabric panel. The polymeric fibers typically are two-component, or bi-component, fibers. Typically, the bi-component fiber has a core and sheath structure, with the core having a higher melting point than the sheath. Other components may be present in minor proportion.

Embodiments of the disclosure are directed to a rigid nonwoven composite fabric panel having high strength and excellent acoustical suppression. A nonwoven composite fabric web and a partially bonded web embodiment serve as precursors for a rigid nonwoven composite fabric panel.

In embodiments of the disclosure, mineral fiber includes man-made fiber that comes from natural raw materials, such as glass fiber, silica fiber, and basalt fiber; carbon fiber; silicon carbide fiber and other polycarbo-silane fibers; and metallic fibers, whether from ductile metals (copper, silver) or brittle metals (nickel, aluminum, iron). Typically, embodiments are selected from the fibers made from natural raw materials. Embodiments of the disclosure are directed to use of glass fiber and basalt fiber, more typically glass fiber.

The type of glass used to make glass fiber suitable for use in embodiments of the disclosure may be any glass from which a fiber may be formed. Typically, the glass is selected from a-glass, c-glass, e-glass, s-glass, and other glass types, including ar-glass, which is alkali resistant, r-glass, and h-glass. The skilled practitioner recognizes that these glass types are made from different compounds and therefore have different properties and intended uses. For example, some glasses typically not used in embodiments of the disclosure include e-cr-glass, which has high acid resistance, and d-glass, borosilicate glass with a high dielectric constant. Typically, these latter glass types can be used, but the glass type chosen is a business decision, wherein the cost is balanced with the features. With the guidance provided herein, the skilled practitioner will be able to identify suitable glass fiber.

In embodiments of the disclosure, e-glass often is used. In other embodiments, a-glass or s-glass typically is used.

Glass fiber typically used in embodiments of the disclosure is roving chopped to a pre-selected length. The length of the glass fiber typically is selected to be suitable for use in a carding system or in an air laid system. Typically, for carding, the glass fiber is chopped, if necessary, to between about 0.5 inches and about 3 inches long, more typically between about 0.75 inches and about 2 inches, and most typically between about 1 inch and 2 inches. The skilled practitioner recognizes that fibers less than about 0.5 inches long typically are not properly processed in a carding system, and fibers longer than about 3 inches long typically tangle and therefore often do not properly distribute in a carding system. In an air-laid system, the fiber length typically is between about 0.5 inches to about 4 inches, and more typically between about 1 inch and about 3 inches.

In embodiments of the disclosure, the diameter of mineral fibers may depend upon the chemical composition thereof, typically between about 5 microns and about 20 microns. For example, glass fibers typically have a diameter between about 5 microns and about 20 microns, typically between about 8 microns and about 18 microns, and more typically between about 10 microns and about 15 microns, or between about 13 microns and about 17 microns. Basalt fibers typically have a diameter between about 5 microns and about 18 microns, and more typically between about 5 microns and about 12 microns.

The glass fiber typically is treated or coated to ensure compatibility and security of bond between the glass fiber and the bi-component fiber. This type of treatment is common for glass fiber, and the treatment or coating differs, depending upon the identity of the bi-component fiber. The coating often is called size. The skilled practitioner recognizes that size is available for many combinations of fiber and bi-component fiber. When polyethylene terephthalate is the bi-component fiber, the size applied to a glass fiber typically is a non-soluble, thermoplastic-compatible size.

Glass fiber sizing is not a single chemical compound, but a mixture of several complex chemistries, each of which contributes to the sizing's overall performance. The primary components are the film former and the coupling agent. Depending on its formulation, the film former, so called because it forms a film on the glass strands, serves a number of functions. The film former is designed to protect and lubricate the fiber and hold fibers together prior to molding, yet also to promote their separation when in contact with resin, ensuring wetout of all the filaments. The film formers of the disclosure are chemically similar to the matrix resin for which the sizing is designed.

The coupling agent, almost always an alkoxysilane compound, serves primarily to bond the fiber to the matrix resin. Silanes offer just what is needed to bond two highly dissimilar materials—the glass fiber, which is hydrophilic (bonds easily to water), bonds to a resin that is hydrophobic (insoluble in water and does not bond well to it). Silanes have a silicon end that bonds well to glass and an opposing organic end that bonds well to resins.

Beyond these two major components, sizings also may include additional lubricating agents, as well as antistatic agents that keep static electricity from building up on the nonconductive fibers as they are formed and converted at high speeds. Including additives for specialized, proprietary functions, a sizing formulation might contain eight to ten or more components. The interaction of these components with each other, with the matrix resin, and within a particular converting/fabricating environment is quite complex, yet reasonably well understood by sizing chemists. With the guidance provided herein, the skilled practitioner will be able to ensure that the glass fibers are appropriately sized for used in embodiments of the disclosure.

Figure 3:
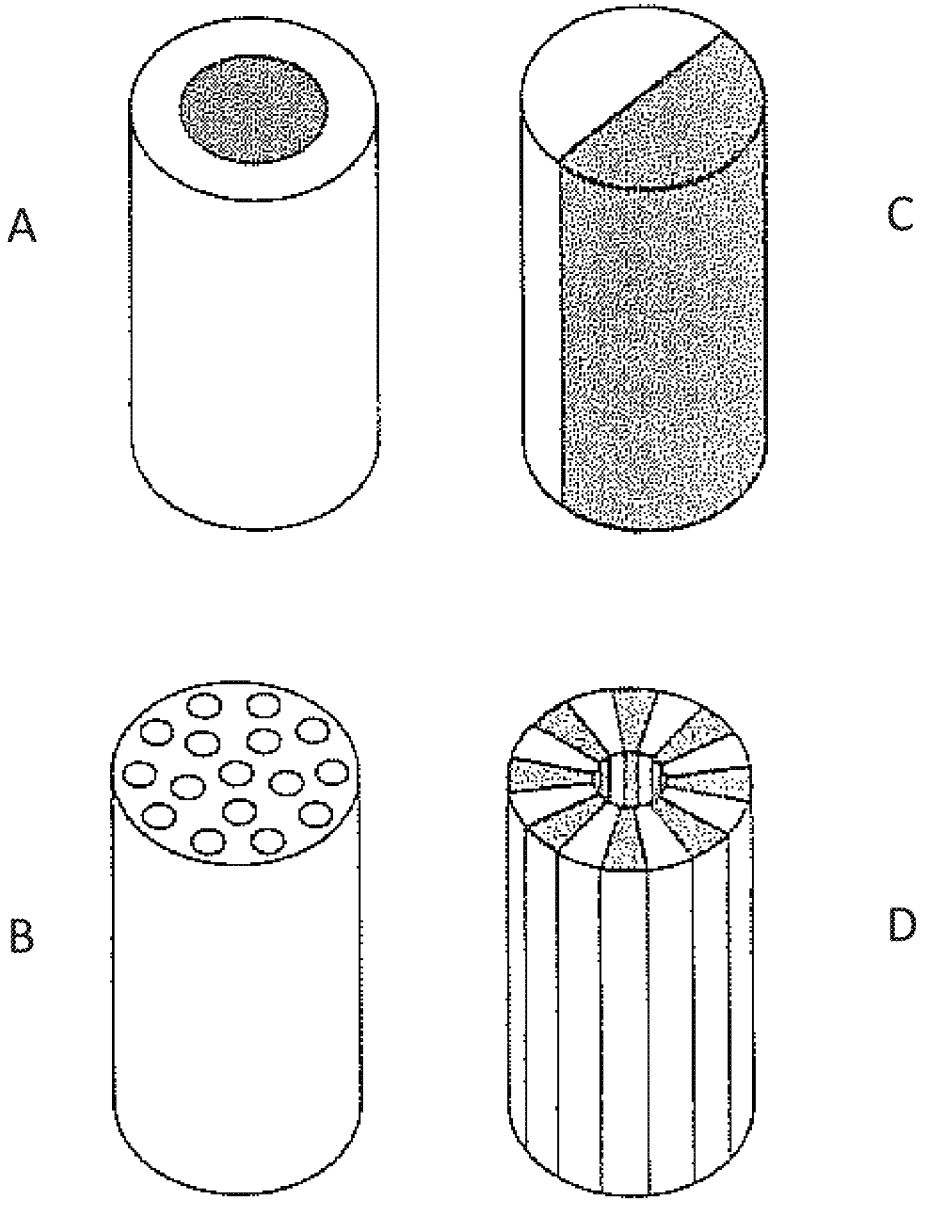
FIG. 3 depicts four forms of bi-component fibers.

The polymeric fibers are two-component, or bi-component, fibers. FIG. 3 depicts four forms or arrangements of bi-component fibers. Typically, the bi-component fiber has a core and sheath structure, i.e., the material in the core is surrounded by the material that forms the sheath. Typically, the sheath material essentially completely surrounds the core material. Thus, the sheath forms an annulus around the core. This structure is depicted in FIG. 3 at A. Another suitable arrangement is several cores surrounded with sheath material, sometimes known as an "islands in the sea" arrangement. This structure is depicted in FIG. 3 at B. Alternatively, the sheath material may cover a lesser part, for example, up to one-half or three-quarters, of a core material. Alternatively, the sheath material may be adjacent to and in intimate contact with the core material, such as in a 'side-by-side' (FIG. 3 at C) or 'segments of a pie' (FIG. 3 at D) arrangement. In each of these constructions, the sheath material is in intimate contact with or essentially surrounds the core material. With the guidance provided herein, the skilled practitioner will be able to identify and select a suitable form of bi-component fiber for use in embodiments of the disclosure.

The skilled practitioner recognizes that the diameter of the core and the diameter of the sheath of such a fiber can be established to provide selected properties and characteristics for the polymeric fibers and for the mat. Typically, the ratio of core mass to sheath mass is between about 1:1 to about 5:1. In other words, typically, the weight of the core is between about 50 wt percent and about 83 wt percent of the weight of the bi-component fiber. Although any reasonable sizes for core and sheath, and any reasonable ratio for the proportions thereof, suitably are used in embodiments of the disclosure, the skilled practitioner recognizes that commercial products are available in typical sizes and ratios. Bi-component fiber is commercially available in sizes ranging from about 1.5 denier to about 20 denier. In embodiments of the disclosure, typical bi-component fiber size is between about 2 denier and about 18 denier, more typically between about 2 denier and about 15 denier, even more typically between about 3 denier and about 15 denier, and most typically is between about 3 denier and about 5 denier.

The skilled practitioner recognizes that the number of fibers present in a given mass is greater at low denier than at a higher denier in the same mass. Although the inventors do not wish to be bound by theory, it is believed that the lower denier values provide a superior product because the greater number of fibers available for bonding with the glass fibers provides greater strength and other improved properties and characteristics.

The core material of the polymeric fibers is a homopolymeric polyester that has a higher melting point than the sheath material. Typically, the polyester is polyethylene terephthalate, also known as PET. The softening point of the core material is at least about 250° C. (482° F.) and typically is at least about 260° C. (500° F.), with melting points even higher.

The sheath material of the polymeric fibers is a copolymeric polyester material that has a lower melting point than the core material. Typically, the polyester material is copolymeric polyethylene terephthalate that has a melting or softening point below that of the core softening point.

Typically, any relationship between the melting or softening temperatures of the core and of the sheath can suitably be used in embodiments of the disclosure. A number of commercially available products have a sheath melting temperature of between about 110° C. (230° F.) and about 220° C. (428° F.). Often, a product having a sheath melting temperature of about 110° C. (230° F.) is considered a "low melt" product; and, at about 180° C. (356° F.) is considered "high melt."

Another suitable product is a crystallizing PET/copoly-PET bimodal product. This product has a sheath melting temperature of about 220° C. (428° F.). When the sheath cools to ambient temperature, the cooled copolymer may form crystalline solid. The crystalline solid provides additional rigidity to the products that are embodiments of the disclosure.

Yet another suitable product is made of copolyester PET, also known as PETG. PETGs are made using a second glycol in addition to ethylene glycol during polymerization. One glycol typically used to form PETG is cyclohexanedimethanol. The molecular structure resulting from the use of a second glycol is irregular, so adjacent polymeric chains of PETG do not 'nest' as PET chains do. Therefore, the resin is amorphous with a glass transition temperature of about 88° C. (190° F.). PETG typically is clear. PETGs can be processed over a wider processing range than conventional PETs and offer good combinations of properties and characteristics such as toughness, clarity, and stiffness.

The polymeric fibers typically have about the same length dimension as the mineral fiber. Thus, the length of the polymeric fibers is between about 0.5 inches and about 3 inches long, more typically between about 0.75 inches and about 2 inches, and most typically between about 1 inch and 2 inches. The skilled practitioner recognizes that fibers less than about 0.5 inches long are not properly processed in a carding system, and fibers longer than about 3 inches long tangle and do not properly distribute in a carding system.

With the guidance provided herein, the skilled practitioner can select a polymeric fiber that melts and bonds to the mineral fiber at a pre-selected temperature.

In embodiments of the disclosure, the mineral fibers comprise between about 5 wt percent and about 90 wt percent, based on the total weight of the fibers, typically between about 10 wt percent and about 80 wt percent, based on the total weight of the fibers. In embodiments of the disclosure in which the mineral fiber is glass, the glass fibers comprise between about 5 wt percent and about 80 wt percent, based on the total weight of the fibers, typically between about 10 wt percent and 70 wt percent, based on the total weight of the fibers.

Figure 4:
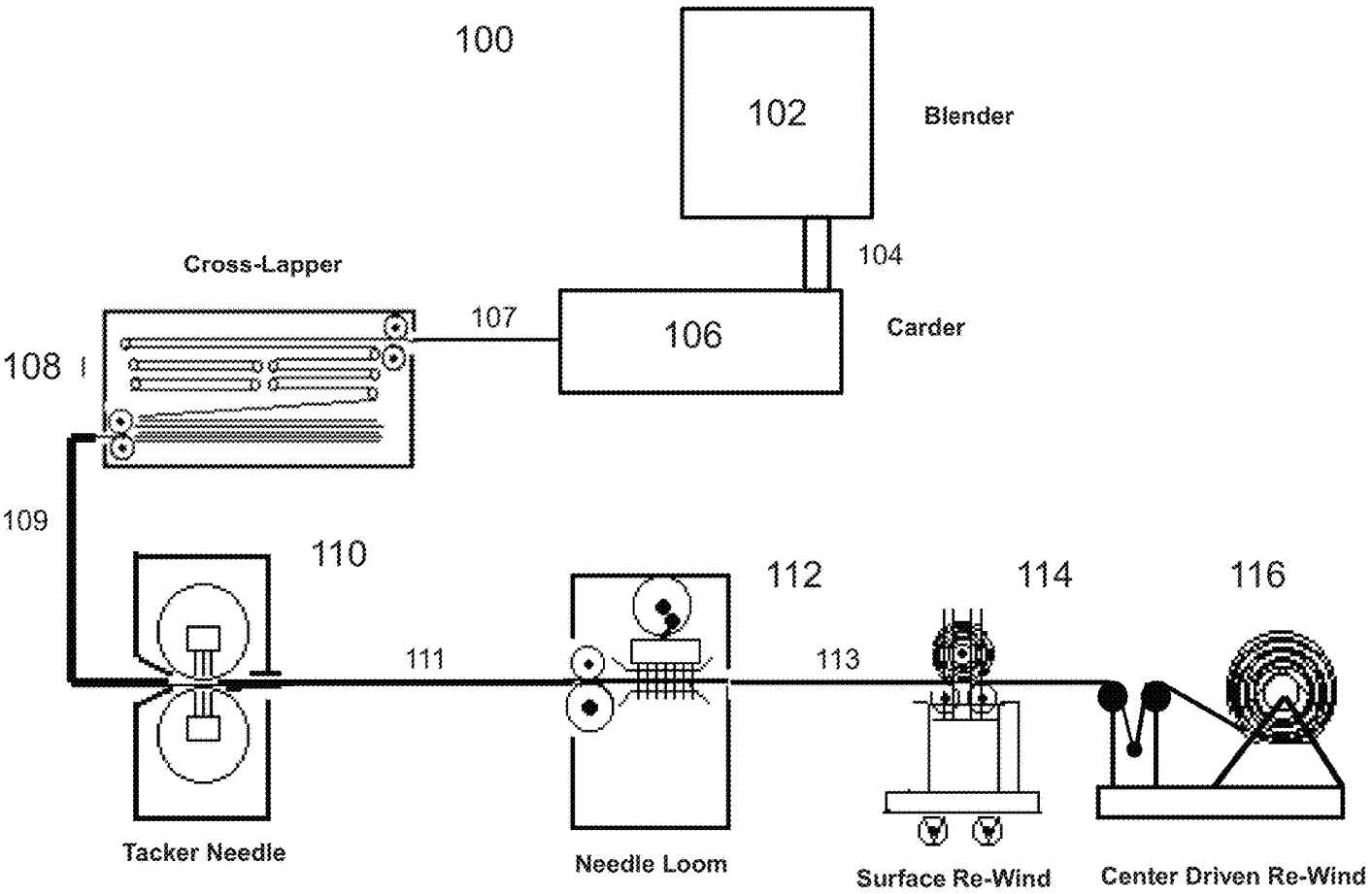
FIG. 4 depicts schematically a method in accordance with an embodiment of the disclosure for forming web.

FIG. 4 depicts schematically method 100 in accordance with embodiments of the disclosure. In accordance with embodiments of the disclosure, the two fiber types are mixed in blender 102 in pre-selected proportions to form a blend of fibers. Typically, the blend is made homogeneous so as to ensure that fibers of the two types are well-blended and will be in intimate contact with each other after carding or air laying. Greater degrees of homogeneity ensure that the polymeric fibers are well-bonded with the mineral fibers. Lesser degrees of homogeneity cause masses of mineral fibers to clump together, precluding bonding with the polymeric fibers. Thus, there may be unbound mineral fibers in poorly homogenized material. Although the inventor does not wish to be bound by theory, it is believed that these essentially unbound masses reduce the quality of the resultant mass, because the unbound fibers contribute little to strength. Similarly, bound masses of polymeric fibers devoid of mineral fibers have significantly less strength than combined masses. Therefore, a high degree of homogeneity is typical in embodiments of the disclosure.

The blend of fibers is passed at conduit 104 to the next processing step. Typically, a homogeneous web of the combined fibers then is formed. Typically, a dry method of forming, such as carding or air laying, is used. Thus, the combined fibers are carded in carder 106 to form a nonwoven web of fibers 107.

The thickness of web 107 formed by the carder typically is between about 0.125 inches and about 1.5 inches, more typically between about 0.375 inches and about 0.5 inches. The thickness of the web 113 used to form a bound web, which may have one or more layers of web 107 from the carder, is selected to provide a nonwoven composite fabric product that, after processing, has pre-selected properties and characteristics, such as thickness, sound dampening, or strength. The thickness depends also upon the degree of pressing that will be utilized. The thickness of the web formed into a partially bonded web, and then into a nonwoven composite fabric panel, typically is between about 0.5 inches and about 36 inches, more typically between about 4 inches and about 16 inches. With the guidance provided herein, the skilled practitioner can determine a proper thickness for the web.

The nonwoven composite fabric web used to form product also may be formed in one pass, or may be formed of plural layers of web from the carder. A web 107 formed in carder 106 passes to cross-lapper 108 to assemble plural layers of web 107 from the carder 106 to form unneedled web 109. The skilled practitioner recognizes that the web 107 exits the carder in the "machine direction," but can be laid in essentially any orientation onto, for example, a continuous belt or a previously-formed web from the carder.

The layers can be laid in the same direction or in different directions. For example, successive layers can be laid at a 45° angle to the previous layer, or at a 90° angle (perpendicular to the previous layer), or at any angle from 0° (parallel with the previous layer) to 90°. The skilled practitioner recognizes that orienting successive layers at angles different from 0° may yield improved strength or stability, for example, or may help make a property or characteristic isotropic. With the guidance provided herein, the skilled practitioner can determine how to orient layers in a multilayer web.

In embodiments of the disclosure, the web may be needled. The skilled practitioner recognizes that needling is a process by which barbed needles are pressed, typically perpendicularly, into the surface of the web. Needling helps to bind various layers of web from the carder to each other, and to toughen even a single web from the carder.

Although the inventor does not wish to be bound by theory, it is believed that strength in the resultant product is improved by needling. Typically, the needles are barbed so as to carry fibers into the web as the needle is inserted, and the needle can be removed without disentangling the fibers. The barbs thus carry fibers from one layer to another in the mass.

Needles are available in various sizes and configurations, including, for example, the length of the needle (typically between about 2.5 inches and about 5 inches), the length of the barbed portion (typically between about 18 mm and 35 mm), the longitudinal shape of the barbed portion (typically, cylindrical and conical), the cross-section of the barbed portion (typically, round or triangular), the gauge of the needle (between about 8 and about 46), and the barb spacing (variously called regular, medium, close, frequent, single, or high density). In embodiments of the disclosure, the gauge typically is between about 32 and about 40, the barb spacing is regular or high-density, and the longitudinal shape is cylindrical or conical. With the guidance provided herein, the skilled practitioner will be able to select suitable needles for needling the web.

The skilled practitioner recognizes the number of needles in a given area can be selected over a wide range. Typically between about 6 needles/square inch and about 24 needles/square inch are suitable. With the guidance provided herein, the skilled practitioner can determine a reasonable number of needles to be used.

The needling process typically encompasses two steps. First, unneedled web 109 typically is processed in tacker needle 110. The tacker needle needles the fabric only enough to ensure that the plural web layers remain in alignment so as to ensure product quality.

Tacked web 111 then is passed to needle loom 112. At needle loom 112, tacked web 111 is fully needled to form nonwoven composite fabric web 113. Thus-formed nonwoven composite fabric web 113 then can be wound for storage and shipping, further processed to obtain a nonwoven composite fabric partially bonded web, and processed still further to form a nonwoven composite fabric panel product. FIG. 4 illustrates winding nonwoven composite fabric web 113. The web first is passed through surface re-winder 114, which tends to smooth the surfaces of web 114. Then, web 113 is taken up at center-driven re-winder 114, and then passed on to a center-driven rewinder at 116.

Figure 5A:
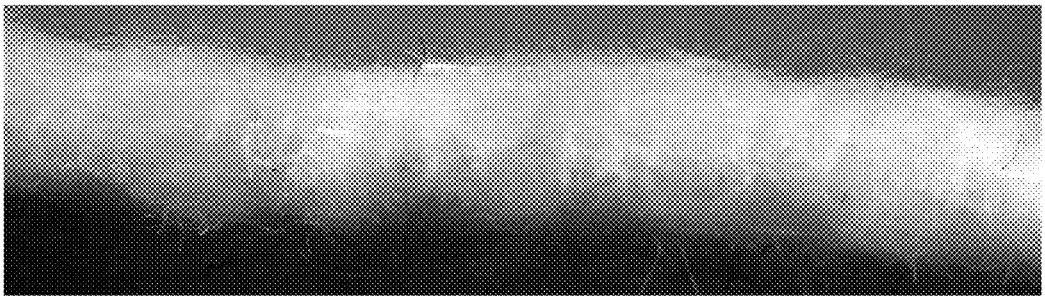
FIGS. 5A and 5B depict two end views of web in accordance with an embodiment of the disclosure.
Figure 5B:
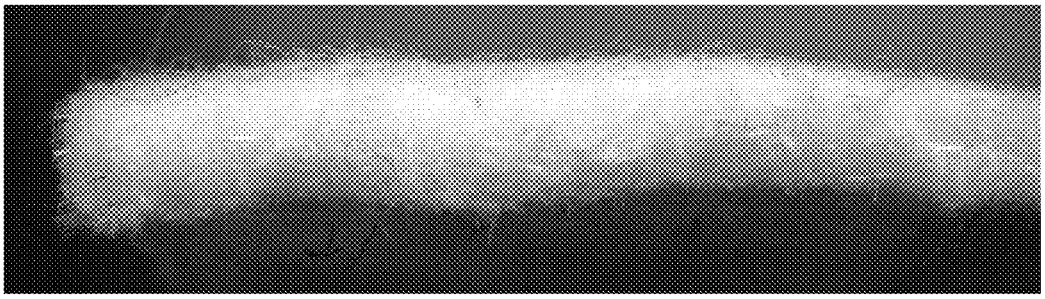

FIGS. 5A and 5B depict cross-sections of two webs 113. FIGS. 5A and 5B illustrate the intertwined nature of the fibers of a web before pressing.

Web 113 also may be further processed after being wound onto spools or otherwise stored. Typically, the web 113 is partially bonded to form a partially bonded web or is fully bonded to form a panel. Therefore, the web is both a precursor for a partially bonded web and for a final product panel, and is a product itself.

Thus-formed web, which is a panel precursor, holds its own shape and retains structural integrity, even though the bi-component fibers and the mineral fibers are not bonded to each other because the bi-component material has not been melted. Although the inventor does not wish to be bound by theory, it is believed that needling is sufficient to retain structural integrity. It also is believed that needling contributes significantly to the strength in the needle direction of the panel. In embodiments of the disclosure, this precursor product can be made and stored for processing at a later time, at another location, or by another party, for example. This fabric web is sufficiently flexible that it can be stored in rolled form. Although the web has sufficient strength to retain structural integrity, the full strength and other significant properties and characteristics of the panel product are not found in the web.

Typically, in embodiments of the disclosure, web 113 is heated and compressed somewhat to better retain structural integrity. For example, the web may be heated for a time sufficient to bond bi-component fibers to mineral fibers in the vicinity of surfaces of the web, but not to bond most of the interior fibers, to produce a partially bonded web. The thickness will be somewhat reduced as well. In this way, a partially bonded web that maintains structural integrity is formed. These embodiments of the disclosure also serve as a precursor to a nonwoven composite fabric panel. In embodiments of the disclosure, this partially bonded precursor product can be made and stored for processing at a later time, at another location, or by another party, for example. This partially bonded web typically is sufficiently rigid that it remains essentially planar. However, the strength and other significant properties and characteristics of the partially bonded web do not rise to the level of these properties and characteristics of the panel product.

Typically, additional processing will be required to obtain a nonwoven composite fabric panel from either the web product or the partially bonded product. Such additional processing typically involves heating and consolidation of the web to bond the fibers, and typically may include shaping in three dimensions, including, for example, bending, in particular to form a particular three-dimensional shape, forming holes, and the like. The panel product is rigid, with strength, acoustical properties, and other significant properties and characteristics that are fully developed.

For example, either precursor web typically is heated sufficiently to melt the sheath layer on the polymeric fiber and bind the fibers to each other to form a bound web. Typically, this first heating step includes pressing to bind and consolidate the web. Such binding can be used to advance the needled web to the partially bonded web. The partially bonded web may be pressed further, typically with heating, to melt the sheath material throughout the product, to both bind all of the fibers together and soften the material being pressed so that it can be shaped.

In embodiments of the disclosure, the web material is formed into a bound web by heating the core and the surface to a temperature above the temperature at which the copolymer PET of the sheath melts. Typically, the temperature to which the web is heated is at least about 252° C. (about 485° F.). In some embodiments of the disclosure, the material typically will be heated in a convection oven at a temperature of about 260° C.-about 288° C. (about 500° F.-about 550° F.). In other embodiments of the disclosure, the heat source may be infrared irradiation, electric resistance devices, such as CalRod® and similar materials, or heated metal platens, particularly oil-heated metal platens.

The skilled practitioner recognizes that the web may be pressed in any manner known. One such pressing system is a pair of compression belts. Compression belts are continuous belts that converge in the direction of movement, i.e., they come closer together so as to impinge upon and press an object between them. In such a system, the web is placed between the compression belts where they are farther apart and is pressed and consolidated as the belts converge. The web thickness thus is reduced, and a bound web of preselected thickness equal to the space between the belts is removed from the end where the belts are closest together. Thus, for example, the belts pass through an oven while the web is heated and pressed, or the belts pass the web past a point heat source.

In embodiments of the disclosure, the web typically is heated in an oven to form a partially bonded web or a panel. For example, a convection oven or a "Thru-Air"-type oven is typical. A "Thru-Air" type oven allows air to flow through the area of a product to be dried. "Thru-Air"-brand ovens are commercially available from Metso of Helsinki, Finland. However, other heat sources, such as a stream of hot air or infra-red irradiation, may be used in embodiments of the disclosure. More than one fixed source may be used, i.e., there may be plural hot air guns arranged along a flow path for the web. Typically, a continuous belt carries the web through the furnace, or past other heat sources.

Another web pressing method employs a heated roller, or a series of such rollers, that press the web layers together to form a partially bonded web. Each roller may be opposed by a similar roller or by another surface, such as a continuous belt. Each roller then pinches the web between the roller and the opposing device to press the mat down to a manageable size. A series of such rollers may reduce the thickness of the web in steps, with the final step forming the nonwoven composite fabric panel. Plate heaters and presses also may be used.

In some embodiments of the disclosure, the web may be heated and pressed to form a partially bonded web in an IR oven, or in a belt-fed laminator with contact heat (a press or platen). Oil-heated platens are used in embodiments of the disclosure. In such heaters, the core of the material must be fully heated without forming a skin over the entirety of the surface. Typically, this goal is achieved by lowering the heating temperature while raising the heating and pressing times. For example, a suitable temperature/time relationship under such conditions is heating with a temperature of between about 252° C. and about 288° C. (about 485° F.-about 550° F.) for a period sufficient to form the panel product. Typically, thinner product requires between about 45 seconds and about 60 seconds, whereas thicker products will require longer periods. With the guidance provided herein, the skilled practitioner will be able to establish a time/temperature relationship for a product without undue experimentation.

Additional processing of a partially bonded web or a web may take place at any time. Thus, processing may continue essentially immediately, or may be interrupted for a period, with additional steps being taken remotely in time from the initial heating step. The partially bonded web is heated to again melt the binding polyester and the partially bonded web is formed to a desired nonwoven composite fabric panel, including both thickness and conformation (shape), and then cooled.

The manner in which the heating and shaping is carried out does not form an important part of this disclosure, as any suitable manner may be employed. Any heating method suitable for the first heating typically is suitable for any subsequent heating step(s).

In embodiments of the disclosure, any subsequent heating can be localized to portions of the web that require softening for additional processing, such as for pressing or bending to form a panel product of the disclosure. This subsequent processing also may include bending, drilling, and other methods for piercing the bound web or resultant product of the disclosure. With the guidance provided herein, the skilled practitioner will be able to identify a suitable method for forming a partially bonded web.

In embodiments of the disclosure, the web is heated to a temperature sufficient to melt the sheath polyester binding material. A temperature that is too low will not melt a quantity of binding material sufficient to bind the fibers and form a web having good structural integrity. A temperature that is too high at best merely wastes energy and, at worst, may damage the web by causing product degradation.

The rate at which nonwoven composite fabric panel is cooled while the product is in the desired shape may affect the quality of the resultant product. In embodiments of the disclosure directed to obtaining three-dimensional products, heated partially bonded web is transferred into an ambient temperature male/female mold. In embodiments of the disclosure directed to obtaining two-dimensional product, heated partially bonded web is transferred into a cooling chamber with upper and lower compression belts. In both cases, the partially bonded web must be kept hot, with both surface and core temperatures above the binder melting point, until the bound web is ready to be molded. During the cooling period, both pressure and cooling must be maintained until the skin temperature is less than about the melting point of the binder. Typically, cooling for up to about 1 minute, and more typically for between about 15 seconds and about 45 seconds, will be sufficient at a density between about 15 lb/ft$^3$ and about 20 lb/ft$^3$. At a product density of about 15 lb/ft$^3$, products have specific densities, or area densities, of, for example, about 500 g/m$^2$ at 2 mm thickness, about 1000 g/m$^2$ at 4 mm thickness, and about 1250 g/m$^2$ at 5 mm thickness. Similarly, a product density of 20 lb/ft$^3$ has a specific density of about 660 g/m$^2$ at 2 mm thickness, about 1320 g/m$^2$ at about 4 mm thickness, and about 1650 g/m$^2$ at a thickness of 5 mm. For panel products 1 inch thick, the specific density is about 8275 g/m$^2$ at a product density of 20 lb/ft$^3$. The skilled practitioner recognizes that a higher density product may require a longer cooling time under pressure and reduced temperature. With the guidance provided herein, the skilled practitioner will be able to find suitable cooling conditions.

Figure 6:
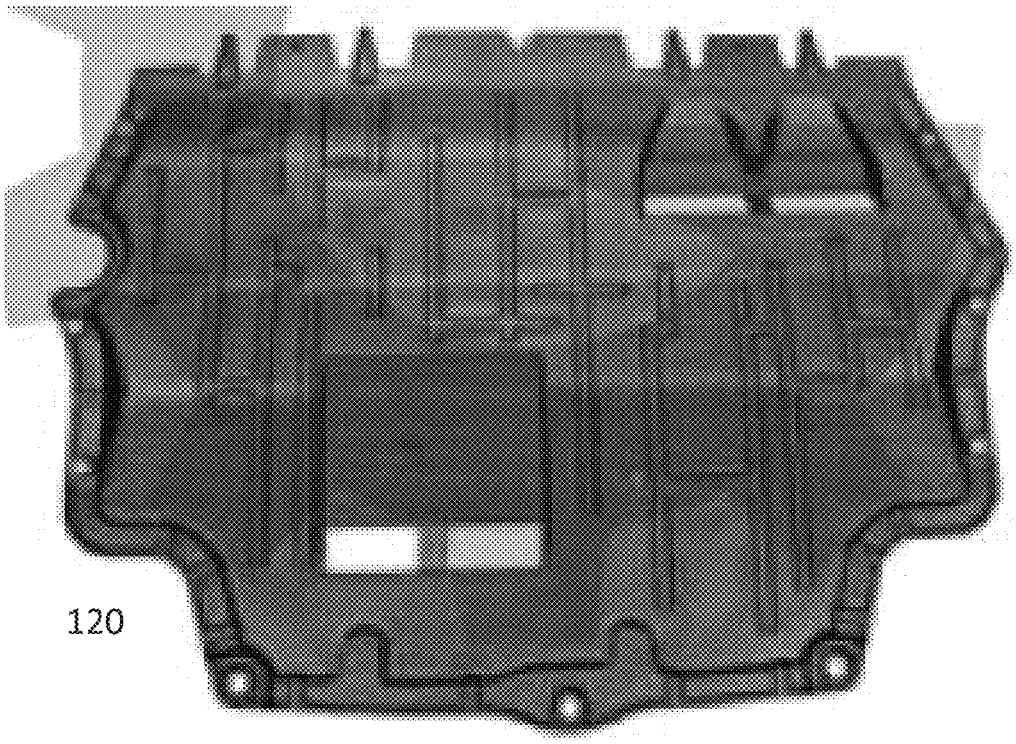
FIG. 6 depicts a three-dimensional panel in accordance with embodiments of the disclosure.

FIG. 6 depicts a three-dimensional panel 120 that is an embodiment of the disclosure. These representative panel products comprise apertures, channels, and other features disclosed in the specification. These features extend both into and out of the plane of the panel.

Embodiments of the disclosure result in nonwoven composite fabric panels that have properties and characteristics that compare favorably with similar products made with polyolefin, and in particular polypropylene. For example, service temperature is higher with PET polymer, and other properties and characteristics are improved. The thickness of panels that are embodiments of the disclosure typically is 2 mm (about 0.08 inches), 4 mm (about 0.16 inches), 5 mm (about 0.21 inches), or between about 0.25 inches and about 1 inch, or between about 0.08 inches and about 1 inch, and typically is no more than 50 percent of the thickness of the web from which it is formed.

Embodiments of the disclosure are directed to a product that is tough, strong, and exhibits excellent acoustical suppression properties and other significant properties and characteristics. In particular, the product remains porous. Further, the product has excellent surface finish. In particular, because the polymeric material is a polyester, especially PET, paint and other coatings may be applied. Adhesion of such coatings to PET is much better than adhesion thereof to polyolefins, such as polypropylene, for example. Further, many adhesives will adhere to a PET substrate and serve as an adhesive for other finishes, such as woven and nonwoven materials and other decorative finishes such as fabric. Also, the surface of the product is easily painted. The skilled practitioner recognizes that nonwoven composite fabric products of the disclosure may have a 'finished' or 'show' side and a 'non-finished' or 'no-show' side, and that these sides may have different properties and characteristics.

Suitable decorative and protective coatings include, without limitation, dye-sublimation, typically for printing and decoration, and paints. The skilled practitioner recognizes that dye sublimation printing involves heating a portion of a dye transfer film to apply heated dye to the substrate product, i.e., the composite panel. Other paints and coatings are used to further protect the product, decorate the product, or provide information to a consumer.

The toughness and strength of the panel product of the disclosure are significant improvements over the properties and characteristics of known products. Although the inventor does not wish to be bound by theory, it is believed that needling contributes significantly to strength in the needling direction. Also, although the inventor does not wish to be bound by theory, it is believed that the amount of low-melt PET present in the product, together with the surviving high-melt PET fibers, serve as more than adhesive agent. Rather, it is believed that the amount of low-melt PET serves as a strengthening agent.

The acoustic properties and characteristics of panel product of the disclosure are superior to the acoustic properties and characteristics of known products of similar strength. Acoustic properties often are expressed in response data, which illustrate the degree of suppression by reporting a percentage suppressed or passed, or a decibel reduction. In particular, acoustic properties and characteristics may be measured in accordance with ASTM E1050, which measures normal incidence sound absorption coefficient over a frequency range. Although the panel product typically is a compressed product, porosity sufficient to attenuate sound is retained. A sound absorption coefficient sufficient to provide a commercially significant noise reduction is achieved over a wide range of frequency in products of the disclosure.

The skilled practitioner recognizes that properties and characteristics of products of the disclosure will be related to the thickness of the product. Properties and characteristics also may depend upon whether the property is measured in the 'machine direction.'

In embodiments of the disclosure, product properties and characteristics include strengths and toughness measured in various manners. For example, tensile strength at maximum load and tensile elongation (Young's) are measured in accordance with ASTM D638. Similarly, flexural modulus is measured in accordance with ASTM D790 (Young's).

Products of the disclosure also resist burning, and pass FMVSS-302.

EXAMPLES

Products of the invention are made by combining chopped e-glass roving and high melting point bi-component polymer fiber comprising PET core and copolymer PET sheath.

The chopped e-glass roving is sized with a thermoplastic-compatible saline solution. The roving has a diameter of 13 microns and is chopped to a 1-inch length. The polymeric fiber has a core to sheath ratio of 3:1 and a diameter of 4 denier. The polymeric fiber has a sheath melting point of 225° C.

The roving and polymeric fiber are mixed, and then carded to form a web having a thickness of 1 inch. Twelve layers of web are stacked, then pressed to form a bound web having a thickness of 0.375 inches. The web is pressed in an oven heated to a temperature of 225° C. and is passed through the oven on compressive belts within 20 seconds to form partially bonded web.

The partially bonded web then is further pressed to form nonwoven composite fabric products of the disclosure having thicknesses of 2 mm, 4 mm, and 5 mm. Properties and characteristics of the various nonwoven composite fabric products, including acoustical response, are set forth in Table 1 and FIG. 1.

TABLE 1

| | | Nonwoven composite fabric thickness | | |
|---|---|---|---|---|
| | Test Method | 2 mm | 4 mm | 5 mm |
| Tensile Elongation (Young's), % | ASTM D638 | 3.60 | 3.60 | 3.50 |

TABLE 1-continued

| | Test Method | Nonwoven composite fabric thickness 2 mm | 4 mm | 5 mm |
|---|---|---|---|---|
| Tensile Stress at Max. Load, psi | ASTM D638 | 2875 | 1725 | 1035 |
| Flexural Modulus, ksi | ASTM D790 Young's | 161.0 | 81.0 | 35.0 |

A comparative product is made with polypropylene and e-glass roving sized for polypropylene. The comparative product is made in accordance with the same method used to make the product of the disclosure, except that temperatures appropriate for polypropylene melting are used.

Figure 2:
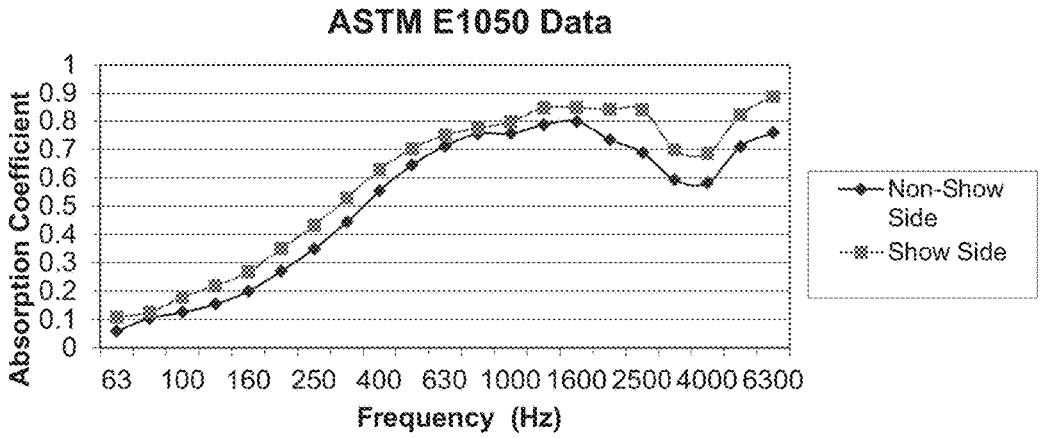
Fig. 2 (Prior Art)
FIG. 2 depicts a portion of a chart that reports the absorption coefficient of a known nonwoven composite fabric panel as a function of frequency.

Properties and characteristics for these comparative examples are set forth in Table 2 and FIG. 2.

TABLE 2

| | Test Method | Nonwoven composite fabric thickness 2 mm | 4 mm | 5 mm |
|---|---|---|---|---|
| Tensile Elongation (Young's), % | ASTM D638 | 3.60 | 3.60 | 3.50 |
| Tensile Stress at Max. Load, psi | ASTM D638 | 2500 | 1500 | 900 |
| Flexural Modulus, ksi | ASTM D790 Young's | 115.0 | 58.0 | 25.0 |

As can be seen, product of the disclosure has better strength and flexural modulus values with otherwise comparable properties and characteristics.

While various embodiments of the invention have been described, the description is intended to be exemplary, rather than limiting and it will be apparent to those of ordinary skill in the art that many more embodiments and implementations are possible that are within the scope of the invention. For example, different mineral fibers, or polymeric fibers having a different melting point, may be used. Accordingly, the invention is not to be restricted except in light of the attached claims and their equivalents. Also, various modifications and changes may be made within the scope of the attached claims.

What is claimed is:

1. A rigid nonwoven composite acoustical fabric panel product formed from a web of an essentially uniform needled blend of:

mineral fiber having a diameter of between about 13 microns and about 17 microns;

bi-component polymeric fiber comprising a first polyester core having a first melting point and a copolymeric polyester sheath having a second melting point lower than the first melting point, the bi-component polymeric fiber having a denier range between about 2 denier and about 15 denier;

the bi-component polymeric fiber comprising between about 50 wt percent and about 83 wt percent core, based on the weight of the bi-component polymeric fiber;

the web having a thickness of between about 0.5 inch and about 36 inches and comprising between about 90 wt percent and about 30 wt percent bi-component polymeric fiber, based on the total weight of the mineral fiber and the bi-component polymeric fiber, the mineral fiber being essentially unbonded to the bi-component polymeric fiber; and wherein the panel product has a thickness not more than about 50 percent of the thickness of the web and between about 0.08 inch and about 1 inch, a specific density of between about 500 g/m$^2$ and about 8275 g/m$^2$, and the bi-component polymeric fiber and the mineral fiber are essentially completely bonded together by copolymeric polyester of the copolymeric polyester sheath.

2. The rigid nonwoven composite acoustical fabric panel product of claim 1, wherein the panel product specific density is at least about 660 g/m$^2$.

3. The rigid nonwoven composite acoustical fabric panel product of claim 1, wherein the bi-component polymeric fiber is a high melt fiber comprising a crystallizing polyethylene terephthalate core and a copolymeric polyethylene terephthalate sheath.

4. The rigid nonwoven composite acoustical fabric panel product of claim 1, wherein the bi-component polymeric fiber comprises a PETG sheath.

5. A rigid nonwoven composite acoustical fabric panel product formed from a partially bonded nonwoven composite fabric web that is comprised of an essentially uniform needled blend of:

mineral fiber having a diameter of between about 13 microns and about 17 microns;

bi-component polymeric fiber comprising a first polyester core having a first melting point and a copolymeric polyester sheath having a second melting point lower than the first melting point, the bi-component polymeric fiber having a denier range between about 2 denier and about 15 denier;

the bi-component polymeric fiber comprising between about 50 wt percent and about 83 wt percent core, based on the weight of the bi-component polymeric fiber;

the partially bonded web comprising between about 90 wt percent and about 30 wt percent bi-component polymeric fiber, based on the total weight of the mineral fiber and the bi-component polymeric fiber, and having at least a part of the mineral fiber and at least a part of the bi-component polymeric fiber at the surface thereof bonded together by copolymeric polyester of the copolymeric polyester sheath to form a partially bonded web having a thickness; and wherein the panel product has a thickness less than the thickness of the partially bonded web and between about 0.08 inches and about 1 inch, a specific density of between about 500 g/m$^2$ and about 8275 g/m$^2$, and the bi-component polymeric fiber and the mineral fiber are essentially completely bonded together by copolymeric polyester of the copolymeric polyester sheath.

6. The rigid nonwoven composite acoustical fabric panel product of claim 5, wherein the panel product specific density is at least about 660 g/m$^2$.

7. The rigid nonwoven composite acoustical fabric panel product of claim 5, wherein the bi-component polymeric fiber is a high melt fiber comprising a crystallizing polyethylene terephthalate core and a copolymeric polyethylene terephthalate sheath.

8. The rigid nonwoven composite acoustical fabric panel product of claim 5, wherein the bi-component polymeric fiber comprises a PETG sheath.

9. The rigid nonwoven composite acoustical fabric panel product of claim 5, wherein the tensile stress at maximum load, as determined by ASTM D638, is 2875 psi at panel thickness of 2 mm; 1725 psi at panel thickness of 4 mm; and 1035 psi at panel thickness of 5 mm.

10. The rigid nonwoven composite acoustical fabric panel product of claim 1, wherein the tensile stress at maximum load, as determined by ASTM D638, is 2875 psi at panel thickness of 2 mm; 1725 psi at panel thickness of 4 mm; and 1035 psi at panel thickness of 5 mm.

11. A rigid nonwoven composite acoustical fabric panel product formed from a web of an essentially uniform needled blend of:

mineral fiber having a diameter of between about 13 microns and about 17 microns;

bi-component polymeric fiber comprising a first polyester core having a first melting point and a copolymeric polyester sheath having a second melting point lower than the first melting point, the bi-component polymeric fiber having a denier range between about 2 denier and about 15 denier;

the bi-component polymeric fiber comprising between about 50 wt percent and about 83 wt percent core, based on the weight of the bi-component polymeric fiber;

the web having a thickness of between about 0.5 inch and about 36 inches and comprising between about 90 wt percent and about 30 wt percent bi-component polymeric fiber, based on the total weight of the mineral fiber and the bi-component polymeric fiber, the mineral fiber being essentially unbonded to the bi-component polymeric fiber; and wherein the panel product has a thickness not more than about 50 percent of the thickness of the web and between about 0.08 inch and about 1 inch, a specific density of between about 500 g/m$^2$ and about 8275 g/m$^2$, an acoustic absorption coefficient of about 0.05 at about 63 Hz, about 0.35 at about 250 Hz, about 0.63 at about 500 Hz, about 0.75 at about 1000 Hz, and about 0.72 at about 2000 Hz, and the bi-component polymeric fiber and the mineral fiber are essentially completely bonded together by copolymeric polyester of the copolymeric polyester sheath.

12. The rigid nonwoven composite acoustical fabric panel product of claim 11, wherein the panel product specific density is at least about 660 g/m$^2$.

13. The rigid nonwoven composite acoustical fabric panel product of claim 11, wherein the bi-component polymeric fiber is a high melt fiber comprising a crystallizing polyethylene terephthalate core and a copolymeric polyethylene terephthalate sheath.

14. The rigid nonwoven composite acoustical fabric panel product of claim 11, wherein the bi-component polymeric fiber comprises a PETG sheath.

15. The rigid nonwoven composite acoustical fabric panel product of claim 11, wherein the tensile stress at maximum load, as determined by ASTM D638, is 2875 psi at panel thickness of 2 mm; 1725 psi at panel thickness of 4 mm; and 1035 psi at panel thickness of 5 mm.

16. A rigid nonwoven composite acoustical fabric panel product formed from a partially bonded nonwoven composite fabric web that is comprised of an essentially uniform needled blend of:

mineral fiber having a diameter of between about 13 microns and about 17 microns;

bi-component polymeric fiber comprising a first polyester core having a first melting point and a copolymeric polyester sheath having a second melting point lower than the first melting point, the bi-component polymeric fiber having a denier range between about 2 denier and about 15 denier;

the bi-component polymeric fiber comprising between about 50 wt percent and about 83 wt percent core, based on the weight of the bi-component polymeric fiber;

the partially bonded web comprising between about 90 wt percent and about 30 wt percent bi-component polymeric fiber, based on the total weight of the mineral fiber and the bi-component polymeric fiber, and having at least a part of the mineral fiber and at least a part of the bi-component polymeric fiber at the surface thereof bonded together by copolymeric polyester of the copolymeric polyester sheath to form a partially bonded web having a thickness; and wherein the panel product has a thickness less than the thickness of the partially bonded web and between about 0.08 inches and about 1 inch, a specific density of between about 500 g/m$^2$ and about 8275 g/m$^2$, an acoustic absorption coefficient of about 0.05 at about 63 Hz, about 0.35 at about 250 Hz, about 0.63 at about 500 Hz, about 0.75 at about 1000 Hz, and about 0.72 at about 2000 Hz, and the bi-component polymeric fiber and the mineral fiber are essentially completely bonded together by copolymeric polyester of the copolymeric polyester sheath.

17. The rigid nonwoven composite acoustical fabric panel product of claim 16, wherein the panel product specific density is at least about 660 g/m$^2$.

18. The rigid nonwoven composite acoustical fabric panel product of claim 16, wherein the bi-component polymeric fiber is a high melt fiber comprising a crystallizing polyethylene terephthalate core and a copolymeric polyethylene terephthalate sheath.

19. The rigid nonwoven composite acoustical fabric panel product of claim 16, wherein the bi-component polymeric fiber comprises a PETG sheath.

20. The rigid nonwoven composite acoustical fabric panel product of claim 16, wherein the tensile stress at maximum load, as determined by ASTM D638, is 2875 psi at panel thickness of 2 mm; 1725 psi at panel thickness of 4 mm; and 1035 psi at panel thickness of 5 mm.

* * * * *